US005517893A

United States Patent [19]

Carvino

[11] Patent Number: 5,517,893

[45] Date of Patent: May 21, 1996

[54] SHOT BAFFLE

[76] Inventor: John Carvino, 42 Winged Foot La., Washington, N.J. 07882

[21] Appl. No.: 454,493

[22] Filed: May 30, 1995

[51] Int. Cl.[6] ..... F42B 33/02

[52] U.S. Cl. ..... 86/31; 86/23; 86/33

[58] Field of Search ..... 86/23–25, 29–33, 86/45

[56] References Cited

U.S. PATENT DOCUMENTS

| | | | |
|---|---|---|---|
| 3,097,560 | 7/1963 | Ponsness et al. | 86/29 |
| 3,450,000 | 6/1969 | Ponsness | 86/25 |
| 3,688,699 | 9/1972 | Horn et al. . | |
| 4,292,877 | 10/1981 | Lee | 86/31 |
| 4,328,735 | 5/1982 | Allen | 86/23 |
| 5,224,465 | 7/1993 | Milliman | 124/76 |

*Primary Examiner*—Harold J. Tudor

[57] ABSTRACT

A shot baffle for use with a funnel secured to a shotgun shell reconditioning and reloading apparatus and with the funnel having an upper open end and an open lower end, the shot baffle including a generally disk-shaped body slidably positionable within the funnel and having a peripheral edge held in slidable contact therewith to create an upper holding chamber for receiving shot disposed within the upper end of the funnel; a plurality of legs with each leg extended downwards from the body and terminated at an end edge and with the end edges of the legs positionable in contact with a portion of the funnel to create a lower chamber therein; and a cylinder extended downwards from the bottom wall and through the lower chamber and terminated at an end positioned in juxtaposition with the lower end of the funnel and with the cylinder having a bore extended therethrough and through the body to allow passage of shot disposed within the upper chamber to the lower end of the funnel.

5 Claims, 4 Drawing Sheets

SHOT BAFFLE

BACKGROUND OF THE INVENTION

1. Field of the Invention

The present invention relates to a shot baffle and more particularly pertains to relieving pneumatic pressure delivered through actuation of a charge bar on a shotgun shell reconditioning and reloading apparatus to prevent shot from being ejected during shotgun shell loading operations and to thereby facilitate easier loading of shot into a shotgun shell with a shot baffle.

2. Description of the Prior Art

The use of baffling mechanisms is known in the prior art. More specifically, baffling mechanisms heretofore devised and utilized for the purpose of relieving pneumatic pressure on shot when loading a shotgun shell are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,450,000 to Ponsness discloses an apparatus for reconditioning and reloading shotgun shells. U.S. Pat. No. 3,688,699 to Horn et al. discloses a self-retaining reload capsule for shotgun shells. U.S. Pat. No. 4,292,877 to Lee discloses an ammunition loader with improved charge bar. U.S. Pat. No. 4,328,735 to Allen discloses progressive shot shell reloading. United States Pat. No. 5,224,465 to Milliman discloses an air gun with baffle for limiting maximum velocity.

While these devices fulfill their respective, particular objective and requirements, the aforementioned patents do not describe a shot baffle that allows pneumatic pressure to be relieved when a charge bar on a shotgun shell reconditioning and reloading apparatus is actuated to facilitate easier loading of shot into a shotgun shell.

In this respect, the shot baffle according to the present invention substantially departs from the conventional concepts and designs of the prior art, and in doing so provides an apparatus primarily developed for the purpose of relieving pneumatic pressure delivered through actuation of a charge bar on a shotgun shell reconditioning and reloading apparatus to prevent shot from being ejected during shotgun shell loading operations and to thereby facilitate easier loading of shot into a shotgun shell.

Therefore, it can be appreciated that there exists a continuing need for new and improved shot baffle which can be used for relieving pneumatic pressure delivered through actuation of a charge bar on a shotgun shell reconditioning and reloading apparatus to prevent shot from being ejected during shotgun shell loading operations and to thereby facilitate easier loading of shot into a shotgun shell. In this regard, the present invention substantially fulfills this need.

SUMMARY OF THE INVENTION

In the view of the foregoing disadvantages inherent in the known types of baffling mechanisms now present in the prior art, the present invention provides an improved shot baffle. As such, the general purpose of the present invention, which will be described subsequently in greater detail, is to provide a new and improved shot baffle and method which has all the advantages of the prior art and none of the disadvantages.

To attain this, the present invention essentially comprises, in combination, a funnel formed of a rigid and generally transparent plastic. The funnel has a central axis, an interior surface, and an exterior surface. The funnel also includes an upper tubular portion aligned with the central axis. The upper tubular portion has an upper open end, a fixed diameter, and a fixed axial length. The funnel also includes a lower tubular portion aligned with the central axis. The lower tubular portion has an open lower end, a diameter less than that of the upper tubular portion, an axial length less than that of the upper tubular portion, and a plurality of threads extending outwards from the exterior surface thereof for allowing its securement within a threaded shot receiving bore of the shotgun shell reconditioning and reloading apparatus. Lastly, the funnel includes an annular-shaped and curved intermediate portion. The annular intermediate portion is aligned with the central axis and interconnects the upper portion with the lower portion. In addition, a lower part of the interior surface of the intermediate portion is flat.

A shot baffle is also provided and formed of a rigid plastic. The shot baffle is slidably disposed within the funnel. The shot baffle includes a disk-shaped body. The body has a central axis, a center, a convex top surface as referenced with respect to the center, a flat planar circular bottom surface, and a peripheral edge with a fixed radius of curvature perpendicularly interconnecting the surfaces. The edge of the body is held in slidable contact with the interior surface of the upper tubular portion of the funnel to define a movable seal therewith and to create an upper holding chamber within the funnel that is positioned above the body for receiving shot.

The shot baffle also includes three legs positioned in a tripodal configuration and extended downwards from the bottom surface of the body. The legs are of equal length. Each leg further has a curved exterior surface that is positioned flush with the edge of the body, a curved interior surface whose cross section defines an arc having a fixed radius as referenced with respect to the central axis of the body, and a border interconnecting the surfaces formed of a pair of side edges and an end edge extended perpendicularly between the side edges at a location remote from the body. The end edges of the legs are positioned in contact with the lower part of the interior surface of the intermediate portion of the funnel to create a lower chamber between the body and the lower tubular portion of the funnel.

A cylinder with an axial length greater than any of the legs is extended perpendicularly downwards from the bottom surface of the bottom wall of the body at a location offset from its center. The cylinder is extended through the lower chamber and terminated at an end positioned within the lower tubular portion of the funnel. The cylinder has an axial cylindrical bore extended therethrough and through the body. The bore is also extended through the top surface of the body. The bore has a diameter sized to allow passage of shot disposed within the upper chamber to the lower tubular portion of the funnel. When the open lower end of the funnel is threadedly secured to the threaded shot receiving bore of the shotgun shell reconditioning and reloading apparatus, and shot is disposed within the open upper end of the funnel, the shot can freely pass through the bore to fill the lower tubular portion of the funnel to a level that leaves a portion of the lower chamber empty to act as a pneumatic pressure buffer when pneumatic pressure is applied through actuation of the charge bar.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shot baffle which has all the advantages of the prior art baffling mechanisms and none of the disadvantages.

It is another object of the present invention to provide a new and improved shot baffle which may be easily and efficiently manufactured and marketed.

It is a further object of the present invention to provide a new and improved shot baffle which is of durable and reliable construction.

An even further object of the present invention is to provide a new and improved shot baffle which is susceptible of a low cost of manufacture with regard to both materials and labor, and which accordingly is then susceptible of low prices of sale to the consuming public, thereby making such a shot baffle economically available to the buying public.

Still yet another object of the present invention is to provide a new and improved shot baffle which provides in the apparatuses and methods of the prior art some of the advantages thereof, while simultaneously overcoming some of the disadvantages normally associated therewith.

Even still another object of the present invention is to provide a new and improved shot baffle for relieving pneumatic pressure delivered through actuation of a charge bar on a shotgun shell reconditioning and reloading apparatus to prevent shot from being ejected during shotgun shell loading operations and to thereby facilitate easier loading of shot into a shotgun shell.

Lastly, it is an object of the present invention to provide a new and improved shot baffle for use with a funnel having an open upper end and open lower end comprising a generally disk-shaped body slidably positionable within the funnel and having a peripheral edge held in slidable contact therewith to create an upper holding chamber for receiving shot disposed within the upper end of the funnel; a plurality of legs extended downwards body with each leg and terminated at an end edge and with the end edges of the legs positionable in contact with a portion of the funnel to create a lower chamber therein; and a cylinder extended downwards from the bottom wall and through the lower chamber and terminated at an end positioned in juxtaposition with the open lower end of the funnel and with the cylinder having a bore extended therethrough and through the body to allow passage of shot disposed within the upper chamber to the lower end of the funnel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
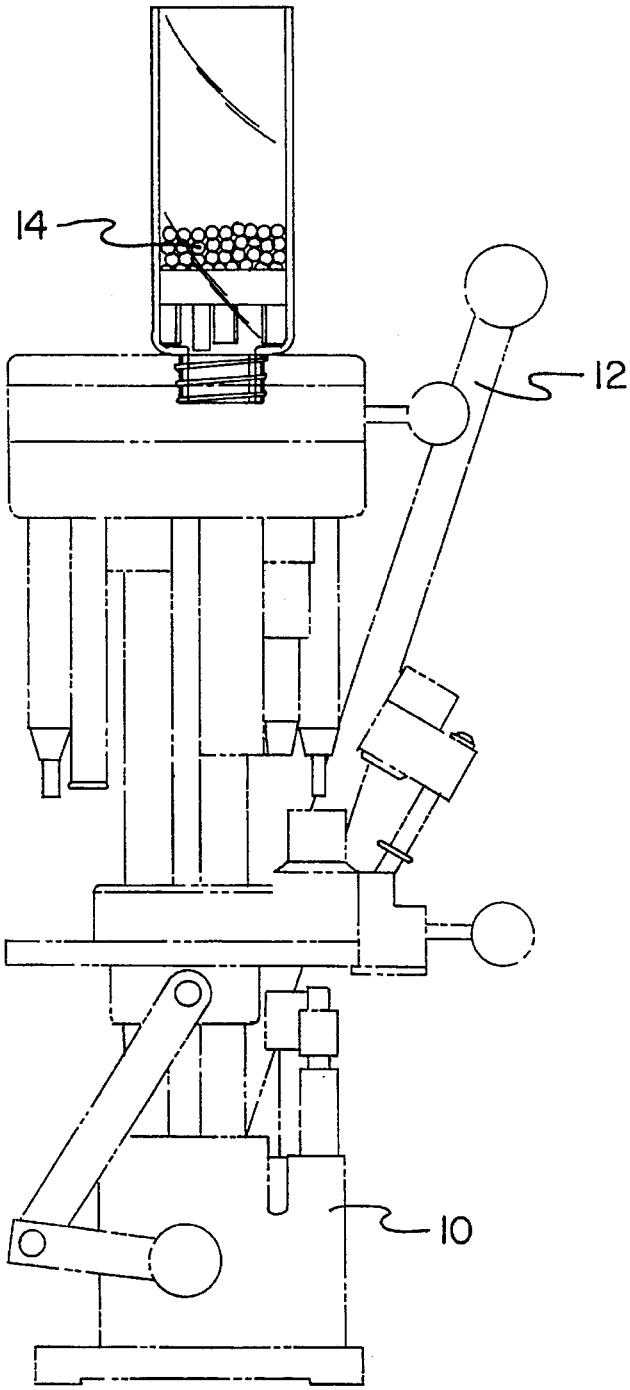
FIG. 1 is a cross-sectional view of the present invention secured for use with a shotgun shell reconditioning and reloading apparatus.
Figure 9:
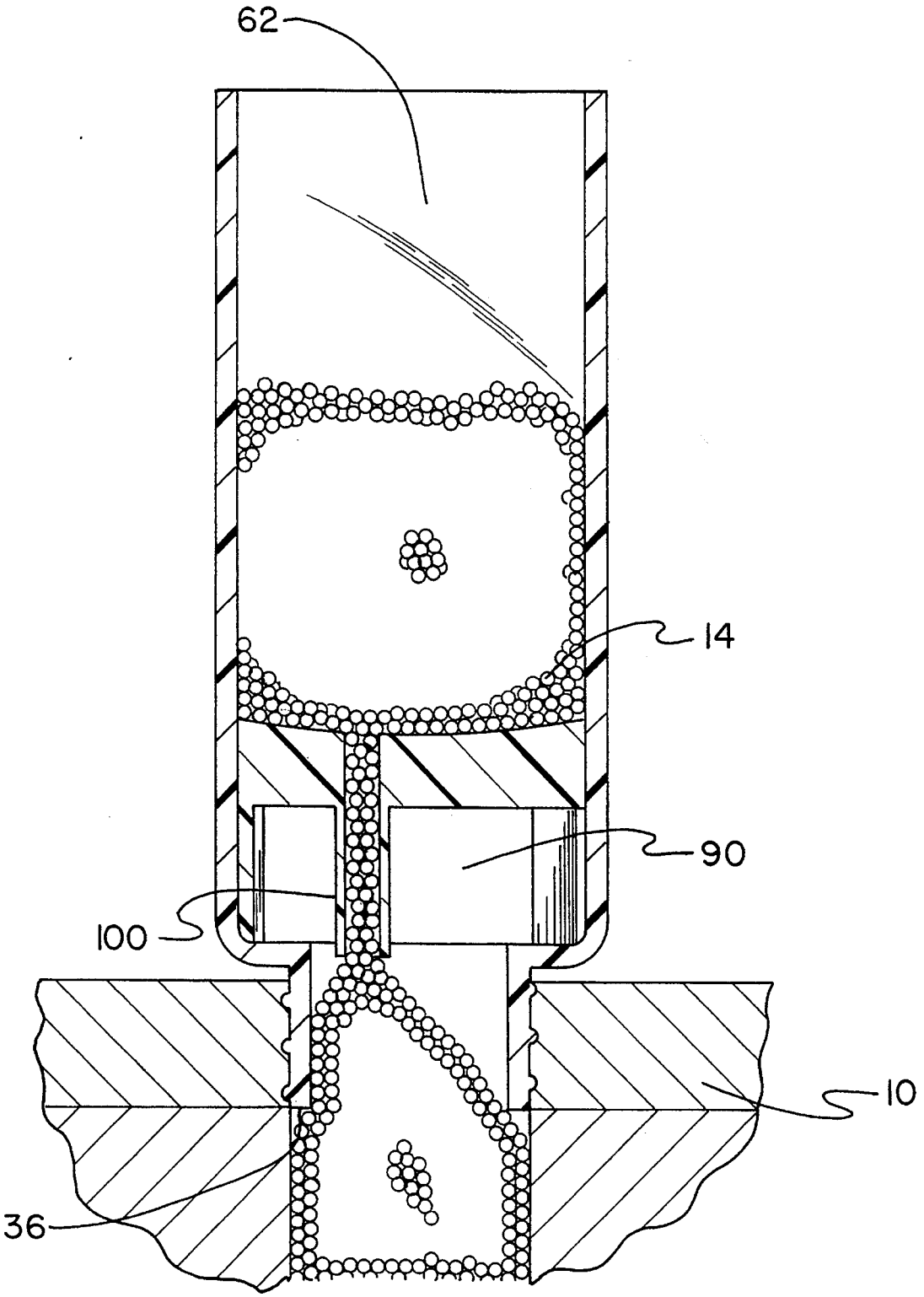
FIG. 9 is a cross-sectional view of the preferred embodiment of the present invention filled with shot for use with the shotgun shell reconditioning and reloading apparatus as shown in FIG. 1.

With reference now to the drawings, and in particular, to FIGS. 1 and 9 thereof, the preferred embodiment of the new and improved shot baffle embodying the principles and concepts of the present invention will be described.

The present invention is adapted for use with a shotgun shell reconditioning and reloading apparatus 10 as shown in FIG. 1. The shotgun shell reconditioning and reloading apparatus 10 includes a charge bar 12 for delivering pneumatic pressure for reloading shotgun shells (not illustrated) with shot. A funnel 20 formed of a rigid and generally transparent plastic is utilized in conjunction with the shotgun shell reconditioning and reloading apparatus 10 for holding and directing shot into the apparatus 10 in reloading operations.

Figure 3:
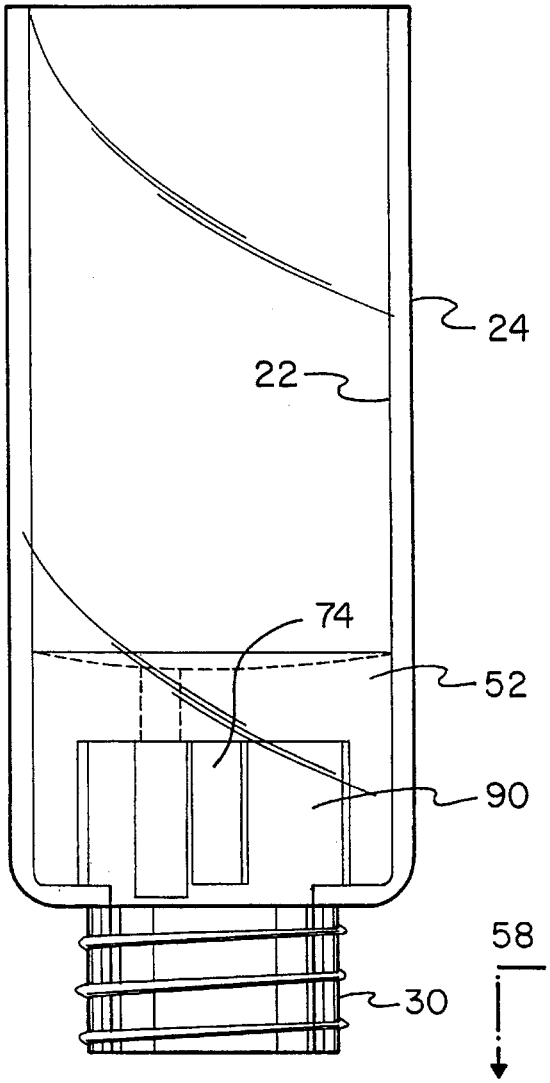
FIG. 3 is a side-elevational view of the present invention.
Figure 4:
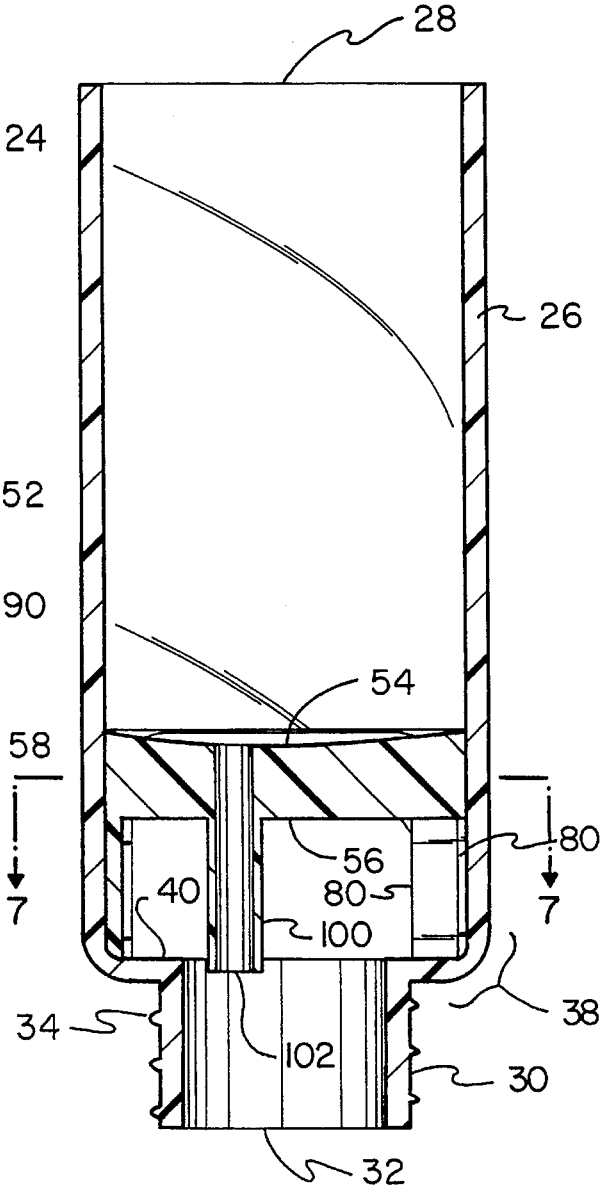
FIG. 4 is a cross-sectional view of the preferred embodiment of the present invention.

The funnel has a central axis, a smooth interior surface 22, and an exterior surface 24 as shown in FIG. 3. In addition, as shown in FIG. 4, the funnel has an upper tubular portion 26 that is aligned with its central axis. The upper tubular portion has an upper open end 28, a fixed diameter, and a fixed axial length. The funnel 20 also includes a lower tubular portion 30. The lower tubular portion is aligned with the central axis of the funnel. The lower tubular portion has an open lower end 32, a diameter less than that of the upper tubular portion, and an axial length less than that of the upper tubular portion. Preferably, the interior diameter of the upper tubular portion is between about 70–75% greater than the interior diameter of the lower tubular portion 30. In addition, the axial length of the upper tubular portion 26 is between about 4–5 times longer than the axial length of the lower tubular portion 30. The lower tubular portion also includes a plurality of threads 34 extended outwards from the exterior surface thereof for allowing its securement within a threaded shot receiving bore 36 of the shotgun shell reconditioning and reloading apparatus 10 as shown in FIG. 9. In addition, the funnel 20 includes an annular-shaped and curved intermediate portion 38. Intermediate portion 38 is aligned with the central axis and interconnects the upper portion 26 with the lower portion 30 in an integral fashion. As clearly shown in FIG. 4, a lower part 40 of the interior surface 22 of the intermediate portion is ring-shaped and flat.

Figure 2:
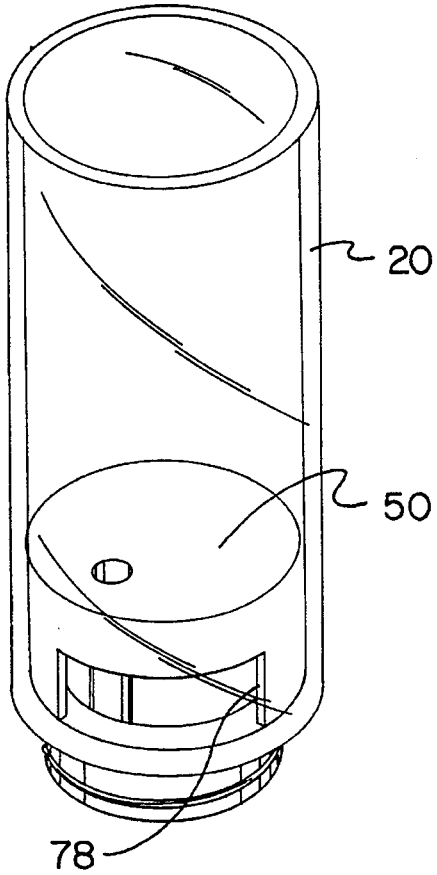
FIG. 2 is a perspective view of the preferred embodiment constructed in accordance with the principles of the present invention.

Also provided is a shot baffle 50 as shown in FIG. 2. The shot baffle is formed of a rigid plastic and is slidably disposed within the funnel 20. The shot baffle in combination with the funnel 20 relieves pneumatic pressure delivered through actuation of the charge bar 12 on the shotgun shell reconditioning and reloading apparatus 10 to prevent shot 14 from being ejected during shotgun shell loading operations and to thereby facilitate easier loading of shot into a shotgun shell.

Figure 7:
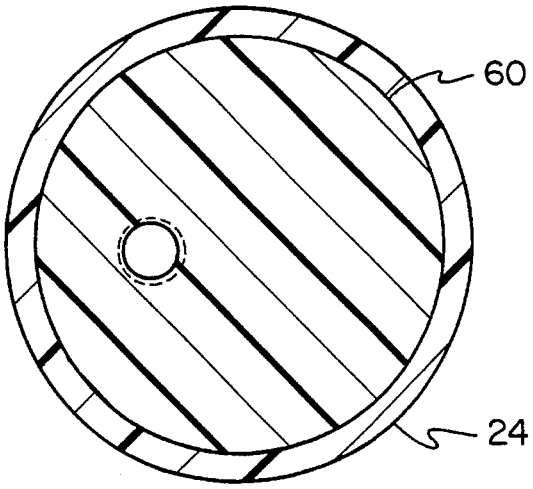
FIG. 7 is a cross-sectional view of the preferred embodiment of the present invention taken along the line 7—7 of FIG. 4.

The baffle 50 includes a disk-shaped body 52. The body has a central axis, a center, a convex top surface 54 as referenced with respect to the center, and a flat circular planar bottom surface 56 that is positioned perpendicular to the central axis of the funnel. The top surface 54 has a nadir aligned with the center of the body 52. A smooth peripheral edge 58 with a fixed radius of curvature perpendicularly interconnects the surfaces 54, 56. The perpendicular distance between the nadir and the bottom surface 56 is between about 15–25% less than the length of the edge as measured between surfaces 54, 56. The peripheral edge 58 is held in slidable contact with the interior surface 22 of the upper tubular portion 26 of the funnel to create a movable seal 60 as shown in FIG. 7. In addition, the baffle in combination with the funnel creates an upper holding space 62 as shown in FIG. 9 that is positioned above the body for receiving shot 14 disposed within the open end 28. The minimal thickness of the body 52 is greater than the thickness of the funnel.

Figure 5:
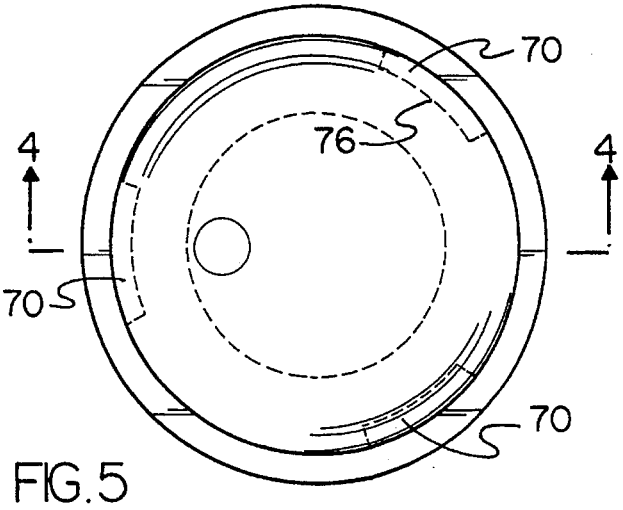
FIG. 5 is a plan view of the preferred embodiment of the present invention.
Figure 6:
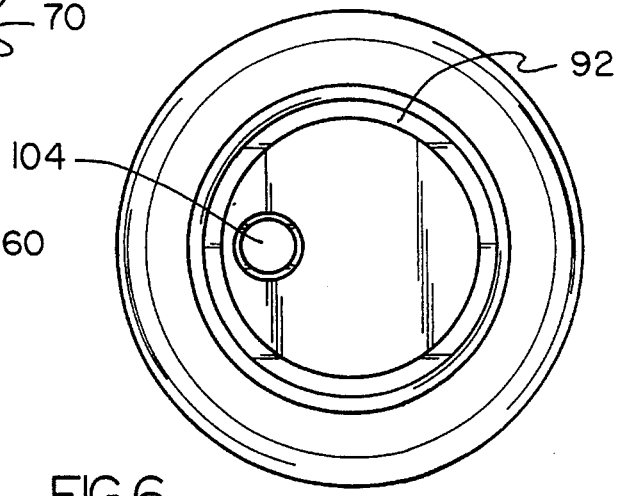
FIG. 6 is another plan view of the preferred embodiment of the present invention.
Figure 8:
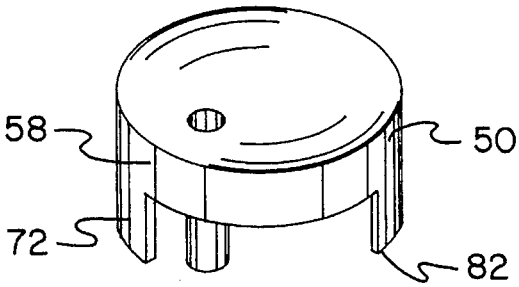
FIG. 8 is a perspective view of the shot baffle when removed from the funnel of the present invention.

The baffle 50 also includes three legs 70 as shown in FIG. 5. The legs 70 are positioned in a tripodal configuration and extended downwards from the bottom surface 56 of the body. The legs are of equal length. Each leg further has a curved exterior surface 72 that is positioned flush with the edge 58 of the body as shown in FIG. 8. Each leg also includes a curved interior surface 74 whose cross-section defines an arc 76 that has a fixed radius as referenced with respect to the central axis of the body 52. The fixed radius of arc 76 is between about 4–5% less than the radius of the body. A border 78 interconnects the surfaces 72, 74. The border is formed of a pair of opposed side edges 80 and an end edge 82. End edge 82 is extended perpendicularly between the side edges 80 at a location remote from the body. The end edges of the legs are positioned in contact with the lower part 40 of the interior surface of the intermediate portion 38 of the funnel to create a lower chamber 90. The lower chamber 90 is located between the body 52 and the lower tubular portion 30 of the funnel as shown in FIG. 3. In an alternate embodiment of the present invention as shown in FIG. 6, the legs can be formed of one tubular integral piece 92.

In addition, a cylinder 100 is integral with and extended perpendicularly downwards from the bottom surface 56 of the bottom wall of the body 52. The cylinder has an axial length greater than any of the legs. Furthermore, the cylinder is positioned at a location offset from the center of the body. The cylinder is extended through the lower chamber 90 and terminated at an end 102. End 102 is positioned within the lower tubular portion 30 of the funnel.

In addition, the cylinder has an axial cylindrical bore 104 extended therethrough and through the body to the top surface 54. The bore has a central axis passing therethrough that is positioned in parallel with the central axis of the body. The distance between the axis of the cylinder and the axis of the body is approximately 50–60% less than the radius of the body. The bore 104 has a diameter sized to allow passage of shot 14 disposed within the upper chamber 62 to the lower tubular portion 30 of the funnel. When the open lower end of the funnel 20 is threadedly secured to the threaded shot receiving bore 36 of the apparatus 10 and shot is then disposed within the upper end 28 of the funnel, the shot can freely pass through the bore 104 to fill the lower tubular portion 30 of the funnel to a level that leaves a portion of the lower chamber empty to act as a pneumatic pressure buffer when pneumatic pressure is applied through hand-actuation of the charge bar 12 by a user. A user can readily set level 110 by looking through the transparent funnel while simultaneously filling it with shot. The shot baffle thus blocks shot that is propelled upwards by pneumatic pressure applied through the charge bar 12 and thereby prevents it from being ejected from the funnel during loading operations.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A shot baffle and funnel system for use with a shotgun shell reconditioning and reloading apparatus, the shot baffle and funnel system in combination relieving pneumatic pressure delivered through actuation of a charge bar on a shotgun shell reconditioning and reloading apparatus to prevent shot from being ejected during shotgun shell loading operations and to thereby facilitate easier loading of shot into a shotgun shell, the shot baffle and funnel system comprising, in combination:

a funnel formed of a rigid and generally transparent plastic having a central axis, an interior surface, an exterior surface, an upper tubular portion aligned with the central axis and having an upper open end, a fixed diameter, and a fixed axial length, a lower tubular portion aligned with the central axis and having an open lower end, a diameter less than that of the upper tubular portion, an axial length less than that of the upper tubular portion, and a plurality of threads extending outwards from the exterior surface thereof for allowing its securement within a threaded shot receiving bore of the shotgun shell reconditioning and reloading apparatus, and an annular-shaped and curved intermediate portion aligned with the central axis and interconnecting the upper portion with the lower portion and with a lower part of the interior surface of the intermediate portion being flat; and a shot baffle formed of a rigid plastic slidably disposed within the funnel, the shot baffle further comprising:

a disk-shaped body with a central axis, a center, a convex top surface as referenced with respect to the center, a flat planar circular bottom surface, and a peripheral edge with a fixed radius of curvature perpendicularly interconnecting the surfaces and with the edge held in slidable contact with the interior surface of the upper tubular portion of the funnel to define a movable seal therewith and to create an upper holding chamber within the funnel that is positioned above the body for receiving shot;

three legs positioned in a tripodal configuration and extended downwards from the bottom surface of the body and with the legs being of equal length, each leg further having a curved exterior surface that is positioned flush with the edge of the body, a curved interior surface whose cross section defines an arc having a fixed radius as referenced with respect to the central axis of the body, and a border interconnecting the surfaces formed of a pair of side edges and an end edge extended perpendicularly between the side edges at a location remote from the body, and with the end edges of the legs positioned in contact with the lower part of the interior surface of the intermediate portion of the funnel to create a lower chamber between the body and the lower tubular portion of the funnel; and a cylinder with an axial length greater than the axial length of any of the legs extending perpendicularly downwards from the bottom surface of the bottom wall of the body at a location offset from its center and through the lower chamber and with the cylinder terminated at an end positioned within the lower tubular portion of the funnel, the cylinder having an axial cylindrical bore extended therethrough and through the body to the top surface and with the bore having a diameter sized to allow passage of shot disposed within the upper chamber to the lower tubular portion of the funnel such that when the open lower end of the funnel is threadedly secured to the threaded shot receiving bore of the shotgun shell reconditioning and reloading apparatus, and shot is disposed within the open upper end of the funnel, the shot can freely pass through the bore to fill the lower tubular portion of the funnel to a level that leaves a portion of the lower chamber empty to act as a pneumatic pressure buffer when pneumatic pressure is applied through actuation of the charge bar.

2. A shot baffle for use with a funnel secured to a shotgun shell reconditioning and reloading apparatus, the funnel having an upper open end and an open lower end, the shot baffle comprising:

a generally disk-shaped body slidably positionable within the funnel and having a peripheral edge held in slidable contact therewith to create an upper holding chamber for receiving shot disposed within the upper end of the funnel;

a plurality of legs of equal axial length extending downward from said body with each leg terminated at an end edge and with the end edges of the legs positionable in contact with a portion of the funnel to create a lower chamber therein; and a cylinder extending downwards from the bottom wall and through the lower chamber and terminated at an end, the cylinder having an axial length greater than the axial length of any of the legs, and with the cylinder having a bore extended therethrough and through the body to allow passage of shot disposed within the upper chamber to the lower end of the funnel.

3. The shot baffle as set forth in claim 2 wherein the body has a central axis, a center, a convex top surface as referenced with respect to the center, and a flat planar circular bottom surface, and wherein the peripheral edge of the body has a fixed radius of curvature that perpendicularly interconnects the surfaces.

4. The shot baffle as set forth in claim 2 wherein a tripodal configuration of three legs is used.

5. The shot baffle as set forth in claim 2 wherein each leg further has a curved exterior surface that is positioned flush with the edge of the body, an interior surface, and a border interconnecting the surfaces formed of a pair of side edges and an end edge.

* * * * *